US005787959A

United States Patent [19]

Laxmanan et al.

[11] Patent Number: 5,787,959

[45] Date of Patent: Aug. 4, 1998

[54] GAS-ASSISTED MOLDING OF THIXOTROPIC SEMI-SOLID METAL ALLOY

[75] Inventors: Venkatasubramanian Laxmanan, Troy; Robert James Hoye, Trenton; Jayprakash Uttamchand Raisoni, Rochester Hills; Suresh Deepchand Shah, Troy, all of Mich.

[73] Assignee: General Motors Corporation, Detroit, Mich.

[21] Appl. No.: 755,859

[22] Filed: Dec. 2, 1996

[51] Int. Cl.[6] ..... B22D 17/10

[52] U.S. Cl. ..... 164/66.1; 164/113; 164/312; 164/900

[58] Field of Search ..... 164/66.1, 259, 164/113, 312, 900

[56] References Cited

U.S. PATENT DOCUMENTS

| | | | |
|---|---|---|---|
| 4,101,617 | 7/1978 | Friederich | 264/93 |
| 4,106,956 | 8/1978 | Bercovici | 148/11.5 A |
| 4,694,881 | 9/1987 | Busk | 164/113 |
| 4,694,882 | 9/1987 | Busk | 164/113 |
| 4,923,667 | 5/1990 | Sayer | 264/572 |
| 5,009,844 | 4/1991 | Laxmanan | 420/548 |
| 5,040,589 | 8/1991 | Bradley et al. | 164/113 |

OTHER PUBLICATIONS

"Thixocasting of Steel", 9th SDCE international die casting Exposition & Congress, Flemings et al, Jun. 6–9, 1977.

*Primary Examiner*—Kuang Y. Lin
*Attorney, Agent, or Firm*—George A. Grove

[57] ABSTRACT

High strength to weight ratio, improved dimensional and surface quality hollow metal moldings are formed by injecting thixotropic, semi-solid metal billets as a "short shot" into a mold cavity; introducing an inert gas into the charge under pressure to force the metal into full and faithful contact with cavity surfaces and to form a hollow portion in the molding; maintaining the pressure of the gas on the charge in the cavity until the metal has solidified and then venting the gas for molded product removal.

2 Claims, 1 Drawing Sheet

GAS-ASSISTED MOLDING OF THIXOTROPIC SEMI-SOLID METAL ALLOY

TECHNICAL FIELD

This invention relates to a method of molding a hollow article from an alloy of, for example, aluminum, tin, copper or magnesium, or other suitable base metal, while such alloy is in a thixotropic semi-solid state. More specifically, this invention relates to a method of utilizing the assistance of pressurized gas in the molding of such a thixotropic semi-solid alloy.

BACKGROUND OF THE INVENTION

It is known how to prepare certain metal alloys so that they have a multi-phased microstructure characterized by a relatively high melting spheroidal or globular phase(s) distributed in a lower melting phase(s). When thus suitably prepared, such alloys can be heated to a temperature at which the alloy is part liquid and part solid. The alloy while in this semi-solid state is relatively soft and can be readily shaped under low loads and fully solidified to form desired articles of manufacture. Such articles or parts typically have low porosity because there is less shrinkage and require little if any machining to complete their manufacture. These parts have all of the other desirable properties of the alloys from which they are made.

Prior to the present invention, many processes have been devised for processing solid metal alloys into a semi-solid thixotropic state so that they are suitable for further low pressure working into useful articles. Solid alloys with a dendritic microstructure are suitably heated, or heated and mechanically stirred, or heated and electromagnetically stirred to form the spheroidal phase in the partly liquid mixture. In some instances, such semi-solid metal is solidified into a billet for subsequent heating and forming. In other instances, the thixotropic semi-solid metal is immediately formed before cooling to the fully solid state.

For example, U.S. Pat. No. 4,694,882 issued Sep. 22, 1987 to R. Busk entitled "Method of Making Thixotropic Materials" discloses the conversion of particles or chips of metal alloy having dendritic grains into a thixotropic semi-solid mass containing spherical grains by controlled heating at temperatures between the fully liquid and fully solid states while subjecting the semi-solid metal to a shearing action such as with a single screw extruder. The applied heat in conjunction with shearing action of the extruder causes the dendritic structure of the alloy to be broken and to form a liquid-solid alloy which can be formed into a useful article at relatively low pressures.

U.S. Pat. No. 5,009,884 issued Apr. 23, 1991 to Laxmanan discloses a process for heating, without mechanical working, dendritic hypoeutectic aluminum-silicon alloy billets to a semi-solid state in which the dendrites are converted to a spherical phase dispersed in a eutectic derived liquid phase. This semi-solid alloy may be used to cast, extrude or mold articles.

U.S. Pat. No. 4,106,956 issued Aug. 15, 1978 to Bercovici discloses a process for facilitating the extrusion or rolling of a solidified dendritic aluminum alloy billet by heating the billet to provide an inner liquid phase of less than 25% by weight and wherein the dendrites have started to develop into a primary solid globular phase without disturbing the solidified character of the billet.

U.S. Pat. No. 5,040,589 to N. Bradley et al. issued Aug. 20, 1991 entitled "Method and Apparatus for the Injection Molding of Metal Alloys" discloses an injector machine which has heating zones to progressively heat metal alloy to between solidus and liquidus temperatures and a shearing element to prepare and inject the material as a thixotropic slurry into a mold to form a product.

In each of the above examples and in others, the semi-solid material may be immediately shaped into an article of manufacture, or the material may be cooled to a solid billet for transport or inventory and later reheating and shaping. However, while the above patent disclosures contemplate the forming of such thixotropic semi-solid alloys into fully dense articles, there has been no available practice for molding hollow articles or articles with a hollow portion by an injection molding process. Further, there has been no available process for the injection molding of semi-solid metal alloys into hollow bodies with high strength to weight ratio, improved surface with less shrinkage and porosity, and lower cycle time.

A purpose of this invention is to provide methods and apparatus to mold thixotropic, semi-solid metal alloys utilizing a suitable gas under pressure to form a hollow part or to form a hollow part with improved surface text.

SUMMARY OF THE INVENTION

In accordance with this invention, a "short charge" (i.e., less than the amount required to fill the cavity) of a thixotropic mass of liquid plus solid metal alloy is rammed or otherwise suitably injected into a mold cavity. The semi-solid metal form is achieved by any suitable practice including one selected from those described above. Generally, the mold cavity will be arranged and shaped to define the outer surfaces of the article to be molded. Heated billets of thixotropic metal being semi-solid but retaining characteristics of a soft solid body can be readily handled and transferred to an injector chamber adapted to heat or maintain the semi-solid billet at a temperature suitable for molding. In an alternative but less efficient practice, a cold or underheated multiphase billet with spheroidal grains in a low melting point matrix may be introduced into the injection chamber and heated there to a semi-solid condition for molding.

The multiphase semi-solid billet (i.e., the charge) is then injected into a mold, preferably without significant shearing action. The volume of the injected mass is controlled so as to amount to a short shot with respect to the volume of the mold cavity. A suitable pressurized inert assist gas (e.g., nitrogen) is then injected into the thixotropic mass of material in the mold to force the material against the mold walls where it solidifies to thereby form a hollow part having a surface that faithfully replicates the mold cavity surfaces. The pressurized gas may be introduced through the injector nozzle or through the sprue or runner or into the mold cavity itself.

The gas can be introduced under a controlled pressure, or to a strolled predetermined volume or at a controlled flow rate to suitably force the semi-solid metal against the mold walls and create the hollow space within the molding. The part cools and fully solidifies with minimal shrinkage because there is less liquid phase initially present. The gas is then vented from the part and mold, and the part is removed from the mold cavity.

Thus, this molding process and apparatus utilizes a short shot of semi-solid metal alloy in combination with a subsequent (or concurrent) injection of gas to produce hollow articles requiring little further machining to shape or surface improvement.

These and other objects, features and advantages of this invention will become more apparent from the following detailed description and drawings in which:

DESCRIPTION OF THE PREFERRED EMBODIMENT

Figure 1:
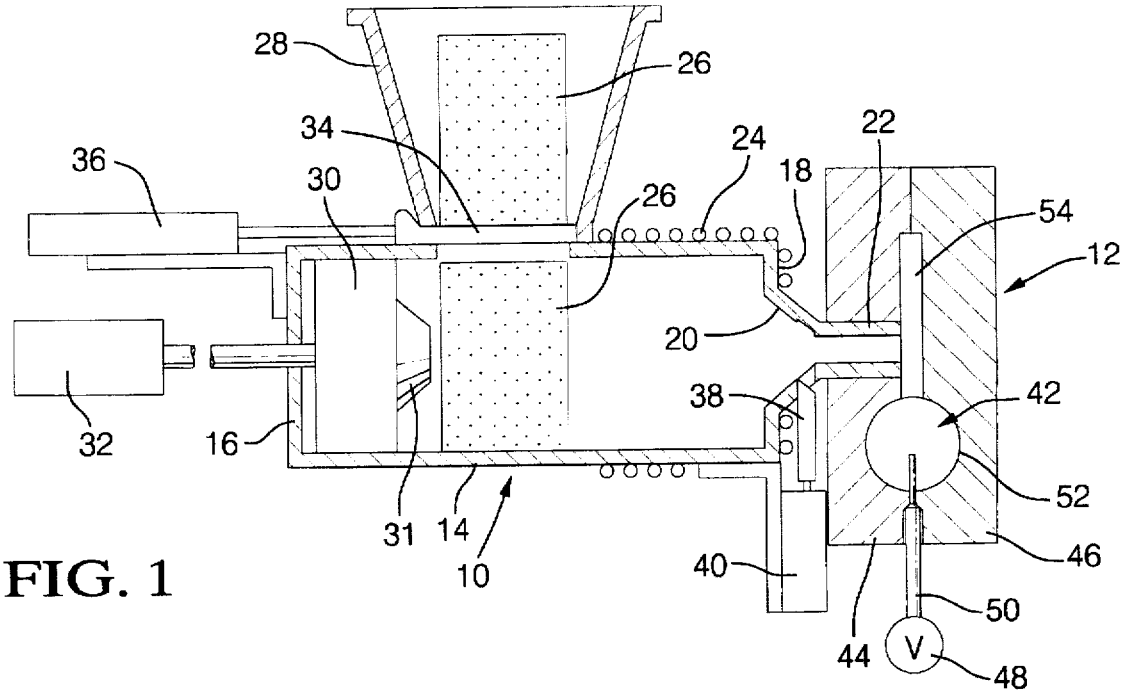
FIG. 1 is a diagrammatic sectional view of a ram-type injection molding machine and mold in a mold-ready position for injection molding hollow thixotropic metal billets.

FIG. 1 illustrates an injection molding machine 10 and communicating mold 12. Molding machine 10 includes injection barrel 14 with a closed upstream end 16. Downstream end 18 includes a tapered nozzle 20 through which a semi-solid metal charge is rammed into the sprue 22 of mold 12. Barrel 14 is heated by electrical resistance heating means (indicated at 24) or other suitable means to heat or maintain the semi-solid charge at a suitable molding temperature.

Thixotropic billets 26 are delivered by any suitable means not shown into feed hopper 28 of the injection molding machine 10. The billets 26 are preferably in a semi-solid, thixotropic condition when delivered to the feed hopper. Thus, for example, if aluminum alloy A357 is the selected molding material, the billet would suitably be at a temperature of about 580° C. to 590° C. A357 is a hypoeutectic aluminum-silicon alloy nominally containing, by weight, 6.5% to 7.5% silicon, less than 0.5% each of magnesium, copper and zinc, and the balance aluminum. When a billet of this alloy has been processed to a suitable microstructure (e.g., by the process of Laxmanan, U.S. Pat. No. 5,009,844) and heated to said temperature, it is in a thixotropic, soft but self-standing state and consisting of about 30% to 40% by volume eutectic liquid and the balance spherical grains of a higher melting point solid phase(s). Such a material is illustrative of the many, usually light weight and relatively low melting alloys that can be molded by the subject invention.

Molding machine 10 has a plunger or ram 30 which is moved to a retracted position as shown in FIG. 1 by hydraulic cylinder 32. The thixotropic billet 26 in hopper 28 is fed into the barrel 14 through valve 34 operated by power cylinder 36. Preferably, the billet is provided in a shape that suitably fills or utilizes the cross section of barrel 14. After billet loading (still referring to FIG. 1), a gate and cutter 38 is moved downwardly by hydraulic cylinder 40 to open the discharge end 18 of the molding machine 10.

Figure 2:
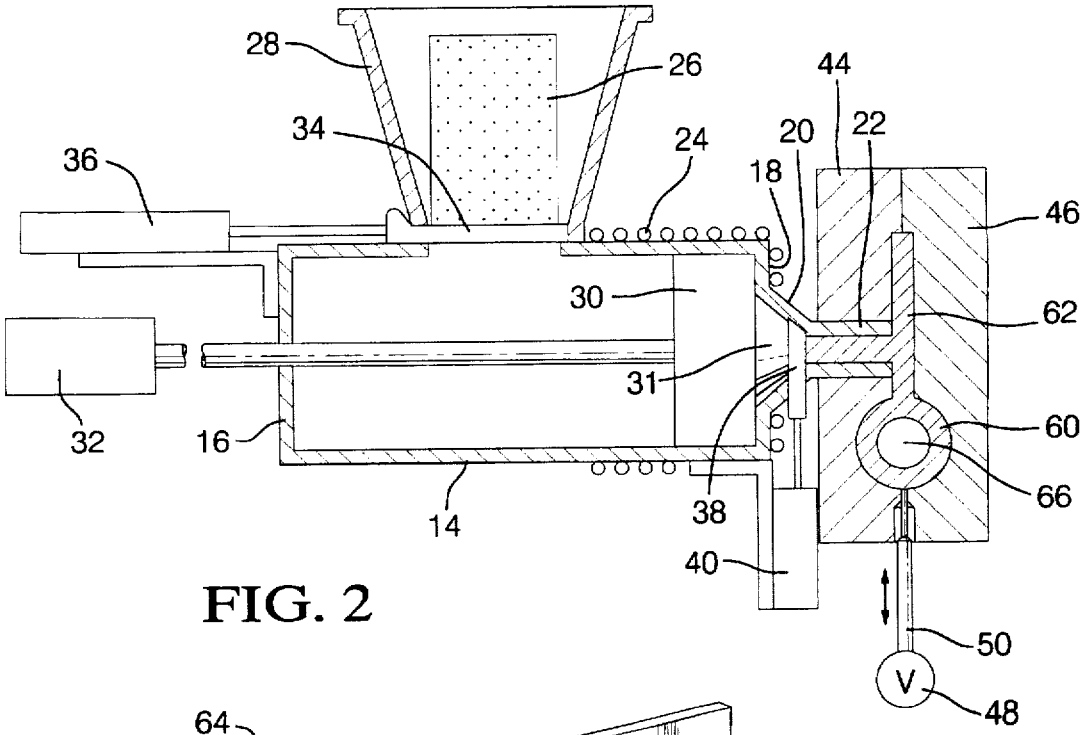
FIG. 2 is a diagrammatic sectional view of the injection machine and mold of FIG. 1 in the injection molding position.

Referring now to FIGS. 1 and 2, injection molding is executed by advancing ram 30 forward (toward the right side of FIG. 1) under hydraulic force at a controlled velocity to squeeze thixotropic material 26 as a paste-like consistency and "short shot" of material of a selected percentage less than of the total volume of mold cavity 42 of mold 12. The mold has fixed mold half 44 and the movable half 46 defining cavity 42 therebetween. The molded part in this example is a tube 60 with a radial flange 62 along its entire length (see FIG. 3). If necessary, depending upon the size and shape of the molding, the mold halves may be heated (not shown) in a region adjacent to cavity 42 by electrical or other suitable means to control solidification of the injected semi-solid material.

After the ram 30 has advanced and squeezed the thixotropic material 26 into the mold cavity 42, the gate 38 is closed behind the charge of thixotropic material. Gate 38 is designed to slide close against the downstream truncated conical face 31 of ram 30 to urge the material in sprue 22 toward the mold cavity 42. Face 31 engages the tapered nozzle 20 to force the charge into sprue 22. After gate 38 is closed, the ram 30 may be withdrawn to its upstream position.

As soon as the charge is in mold cavity 42, inert (i.e., chemically inert with respect to the metal charge) low pressure assist gas, such as nitrogen 15 from a tank source (not shown), is injected through valve 48 into the short shot via gas injector nozzle 50 into cylindrical portion 52 of the cavity 42. The pressure of the assist gas is suitably about 100 psi or higher depending upon such factors as the fluidity of the metal charge and the part design. As the gas is injected, the nozzle 50 is positioned about one-third to one-half way through the cross section of mold cavity 42 (see FIG. 1). The thixotropic metal material of the short shot is forced by the pressure of the assist gas against the profiling interior wall of the mold cavity 42. As shown, the gas is injected into the cylindrical portion 52 of cavity 42 in order to form the hollow tube portion 60 of the part 64 and to force the charge to fill the flange portion 54 of the cavity. The part 64 is solidified by mold cooling.

Figure 3:
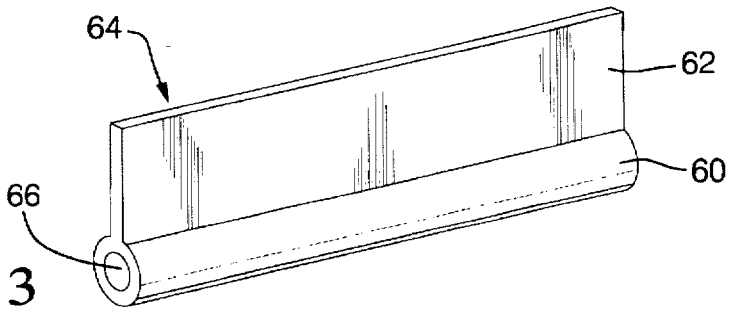
FIG. 3 is a pictorial view of a part produced in the mold cavity of FIGS. 1 and 2.

As solidification progresses, the nozzle and control valve of the gas injection unit are moved from the gas injection position to a point at the outer diameter of the part as shown in FIG. 2 to permit metal flow into the cavity left by the withdrawn nozzle. At the same time or shortly thereafter, gas may be vented through the nozzle. The nozzle is further withdrawn to an open position so that assist gas is vented through an opening created at the parting plane of mold pieces 44 and 46. The solidified part 64 shown in FIG. 3 is ejected or otherwise removed from the mold. The hollow part, here in the form of a hollow tube portion 60 (hollow at 66) with a radial flange 62, has high quality surfaces with no silicon or other nonmetallic inclusions that would cause porosity or detract from the finishing or strength of the molded part. The extraneous sprue portion of the molding is removed from the part and is not seen in FIG. 3.

In general, the location of the gas injection is dependent upon the shape of the part to be molded. If as in the above example with part 64 the hollow portion is in only one region of the part, it is preferred to introduce the inert pressurizing gas directly into the cavity in the region of the hollow portion of the part. Usually, it will be preferred to introduce the gas in the mold cavity. However, e.g., where several parts are being molded in distinct cavities connected to one or more runners, it may then be desirable to introduce the gas into the runner(s) or through the injection nozzle(s) feeding the runner(s).

It will now be appreciated that this invention has substantial utility in the molding of hollow metal articles with good surface quality and lower shrinkage as well as improved dimensional stability with high strength to weight ratio. The pressure of the inert gas forces the semi-solid metal into good contact with the mold surface throughout solidification. As a result, the molded products may require no additional machining. Further, the process is applicable to a wide range of alloys that can be prepared in the form of thixotropic, multiphase, semi-solid materials. Often the alloys are of low density, and further weight reductions are realized because hollow products can be molded.

In the above example, the semi-solid metal charge was depicted as having been prepared prior to being placed in the injection cavity of the molding machine. However, it will be understood that a suitable metal alloy could be heated in an injection chamber to convert it to a semi-solid thixotropic charge for gas-assist molding in accordance with this invention. In other words, an alloy could be introduced into the injection chamber and heat treated by the method of Laxmanan U.S. Pat. No. 5,009,884 to a suitable semi-solid condition for charge into a mold cavity. In another embodiment, particles or chips of a suitable alloy could be fed into an injection chamber with a heater and reciprocating screw extruder and heated and worked into a semi-solid condition by the method of Busk U.S. Pat. No. 4,694,882 or Bradley et al U.S. Pat. No. 5,040,589.

While this invention has been described in terms of certain preferred embodiments thereof, it will be appreciated that other forms could readily be adapted by one skilled in the art. Accordingly, the scope of this invention is to be considered limited only by the following claims.

We claim:

1. A method of making a molded hollow part from a metal alloy comprising:

injecting a charge of thixotropic, semi-solid metal into a mold cavity having product defining surfaces and formed by complementary mold members, the volume of said charge being less than the volume of said cavity;

confining said charge in said cavity and injecting a gas that is chemically inert with respect to said metal into said charge so as to force said metal against the cavity surfaces and to create a hollow region within said metal charge;

cooling the semi-solid metal charge to solidify it while maintaining the pressure of said gas on the charge;

venting the gas from the mold cavity after solidification of the metal; and removing the solidified molding from the cavity and mold.

2. A method as recited in claim 1 in which the gas is injected into said charge at a location in said cavity.

* * * * *